US006394024B1

(12) United States Patent
Piccinino, Jr. et al.

(10) Patent No.: US 6,394,024 B1
(45) Date of Patent: May 28, 2002

(54) COATING APPARATUS FOR PHOTOSENSITIVE MEDIA

(75) Inventors: Ralph L. Piccinino, Jr., Rush; Kevin H. Blakely, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/470,723

(22) Filed: Dec. 22, 1999

(51) Int. Cl.[7] ..... B05C 1/08

(52) U.S. Cl. ..... 118/46; 118/236; 118/500; 226/110; 226/101; 271/9.1

(58) Field of Search ..... 118/46, 236, 500; 226/110, 101; 242/538.1, 598.3, 598.4; 101/219, 232, 479, 480; 400/613, 605, 607, 607.2, 608.1, 641; 271/9.1

(56) References Cited

U.S. PATENT DOCUMENTS

| | | | | |
|---|---|---|---|---|
| 4,081,815 A | | 3/1978 | Horner | 396/614 |
| 4,365,733 A | * | 12/1982 | McNew | 226/109 |
| 4,407,867 A | | 10/1983 | Bruck et al. | 427/365 |
| 4,530,306 A | | 7/1985 | Hovekamp | 118/669 |
| 4,740,075 A | | 4/1988 | Schoernig | 396/614 |
| 4,941,377 A | * | 7/1990 | Ishihara et al. | 271/9.1 |
| 5,228,920 A | | 7/1993 | Thompson, III | 118/670 |
| 5,297,783 A | * | 3/1994 | Howard et al. | 271/9.1 |
| 5,309,192 A | | 5/1994 | Lu | 396/606 |
| 5,439,704 A | | 8/1995 | Sankaran et al. | 427/195 |
| 5,875,370 A | | 2/1999 | Patton et al. | 396/606 |
| 5,905,924 A | | 5/1999 | Patton et al. | 396/614 |
| 5,984,534 A | | 11/1999 | Elderstig et al. | 385/90 |

FOREIGN PATENT DOCUMENTS

| | | |
|---|---|---|
| EP | 0 915 380 | 5/1990 |
| EP | 0 915 377 | 5/1999 |

* cited by examiner

*Primary Examiner*—Laura Edwards
(74) *Attorney, Agent, or Firm*—Frank Pincelli

(57) ABSTRACT

A coating apparatus for applying a coating on to a photographic media. The apparatus includes a coating section for applying a coating on to a photosensitive media having an entrance and an exit. A first supply assembly is provided for supplying a first media of a first format adjacent the entrance. A retractable second retractable supply assembly and a retractable taking-up assembly is provided for supplying and taking up a second media of a second format, the second format being different from the first format.

21 Claims, 14 Drawing Sheets

COATING APPARATUS FOR PHOTOSENSITIVE MEDIA

FIELD OF THE INVENTION

The present invention relates to improvements in or relating to coating apparatuses and more particularly to a coating apparatus for applying a coating on a photosensitive media.

BACKGROUND OF THE INVENTION

It has been found desirable to place a protective coating on photographic media. In particular, photographic prints are relatively sensitive to fingerprints, moisture, and other dirt that may be placed on the surface. Because photographic prints are designed to be viewed, the appearance of fingerprints, smudges or other dirt on the surface thereof can substantially detract from the visual appearance thereof. It has been suggested to provide of a thin protective layer on the photosensitive photographic print. An example of a suitable device for applying such a coating is described in U.S. Pat. Nos. 5,984,534; 5,905,924; 5,875,370 and co-pending U.S. patent application Ser. No. 09/082,957 filed May 21, 1998 entitled "Method and Apparatus for Applying a Solution to a Photosensitive Material" by Ralph L. Piccinino Jr. and Kevin Blakely.

A problem with prior art coating devices is that they are set up to either to apply a coating onto a web of photosensitive media or onto individual prints. Accordingly this requires two different separate devices when individual prints and web media are to be coated.

Applicants have invented an apparatus whereby cut sheets and/or a web of photosensitive media may be coated using a single coating apparatus. This is accomplished by providing means for allowing quick and easy adaptation of the apparatus to either cut sheet or web feed and take-up.

SUMMARY OF THE INVENTION

In accordance with the present invention there is provided an apparatus for applying a coating on to photosensitive material. The apparatus comprising:

- a coating section for applying a coating on to a photosensitive media having an entrance and an exit;
- a first supply assembly for supplying a first media of a first format adjacent the entrance; and
- a retractable second retractable supply assembly and a retractable taking-up assembly for supplying and taking up a second media of a second format, the second format being different form said first format.

The above, and other objects, advantages and novel features of the present invention will become more apparent from the accompanying detailed description thereof when considered in conjunction with the following drawings.

BRIEF DESCRIPTION OF THE DRAWINGS

In the detailed description of the preferred embodiments of the invention presented below, reference is made to the accompanying drawings in which.

DETAILED DESCRIPTION OF THE INVENTION

The present description will be directed in particular to elements forming part of, or in cooperation more directly with, the apparatus in accordance with the present invention. It is understood that elements not specifically shown or described may take various forms well known to those skilled in the art.

Figure 1:
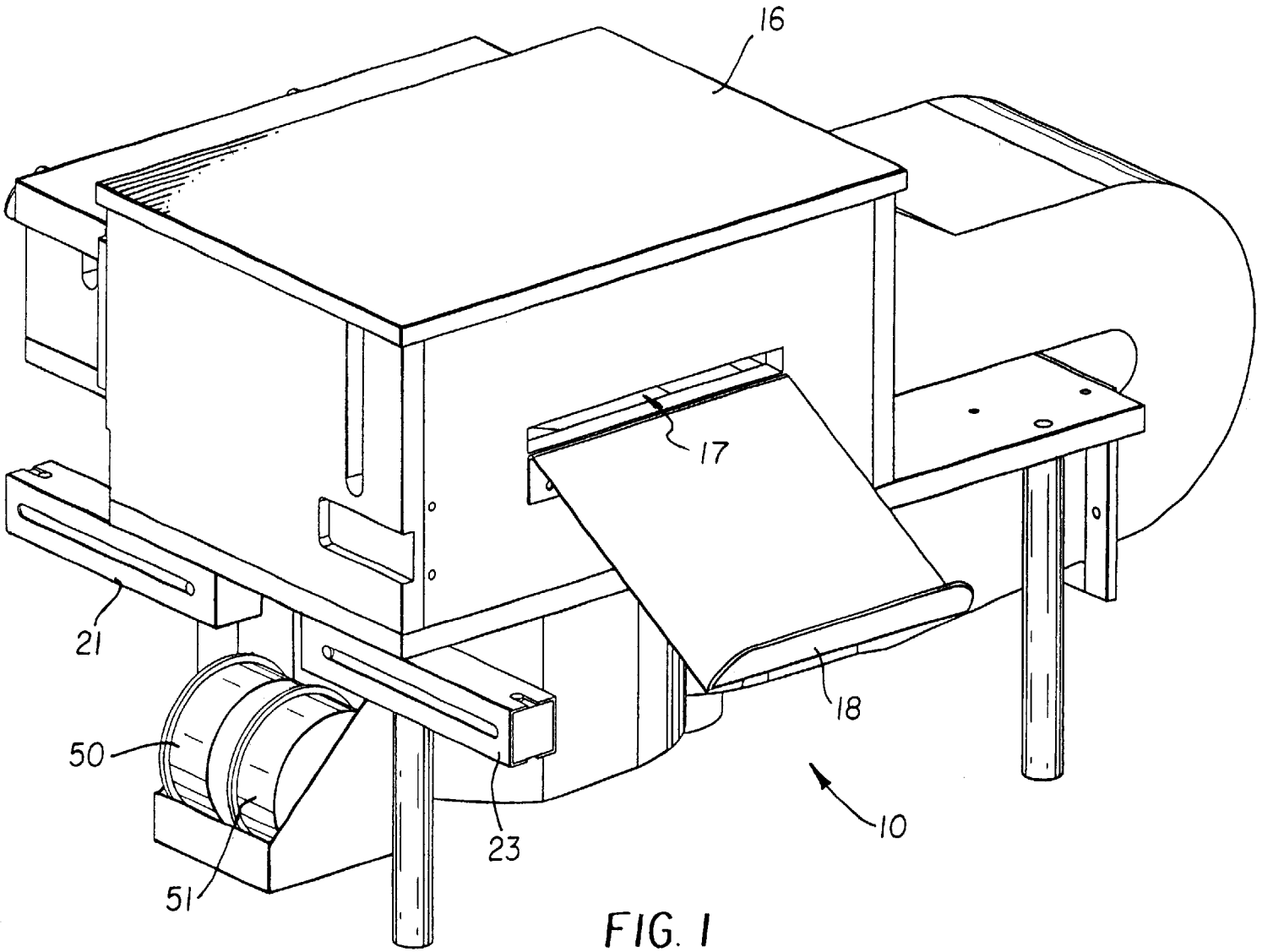
FIG. 1 is a perspective view of an apparatus made in accordance to the present invention in the cut sheet mode of operation as taken from the exit side.
Figure 2:
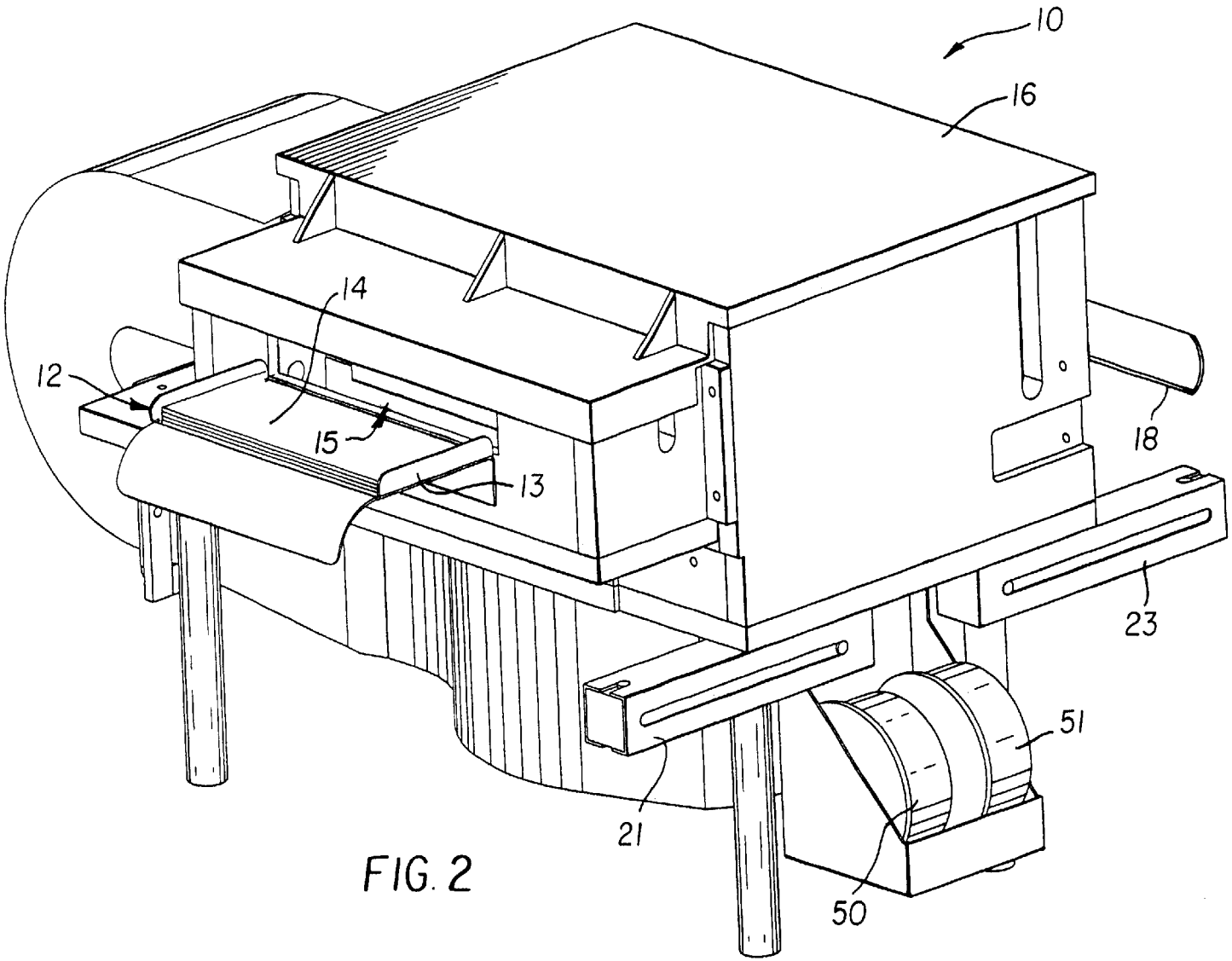
FIG. 2 is a perspective view of the apparatus of FIG. 1 as taken from the supply side.

Referring to FIGS. 1 and 2 there is illustrated an apparatus 10 made in accordance to the present invention. The apparatus 10 is a coating apparatus designed for placing a protective layer of a material onto a web or sheet of media. In the particular embodiment illustrated the apparatus 10 is designed for placing a protective layer on photographic paper provided either in web or sheet form. U.S. Pat. Nos. 5,984,534; 5,905,924; 5,875,370 and co-pending U.S. patent application Ser. No. 09/082,957 filed May 21, 1998 entitled "Method and Apparatus for Applying a Solution to a Photosensitive Material" by Ralph L. Piccinino Jr. and Kevin Blakely, disclose suitable devices for applying a protective coating on a media, all of which are incorporated by reference herein.

Figure 3:
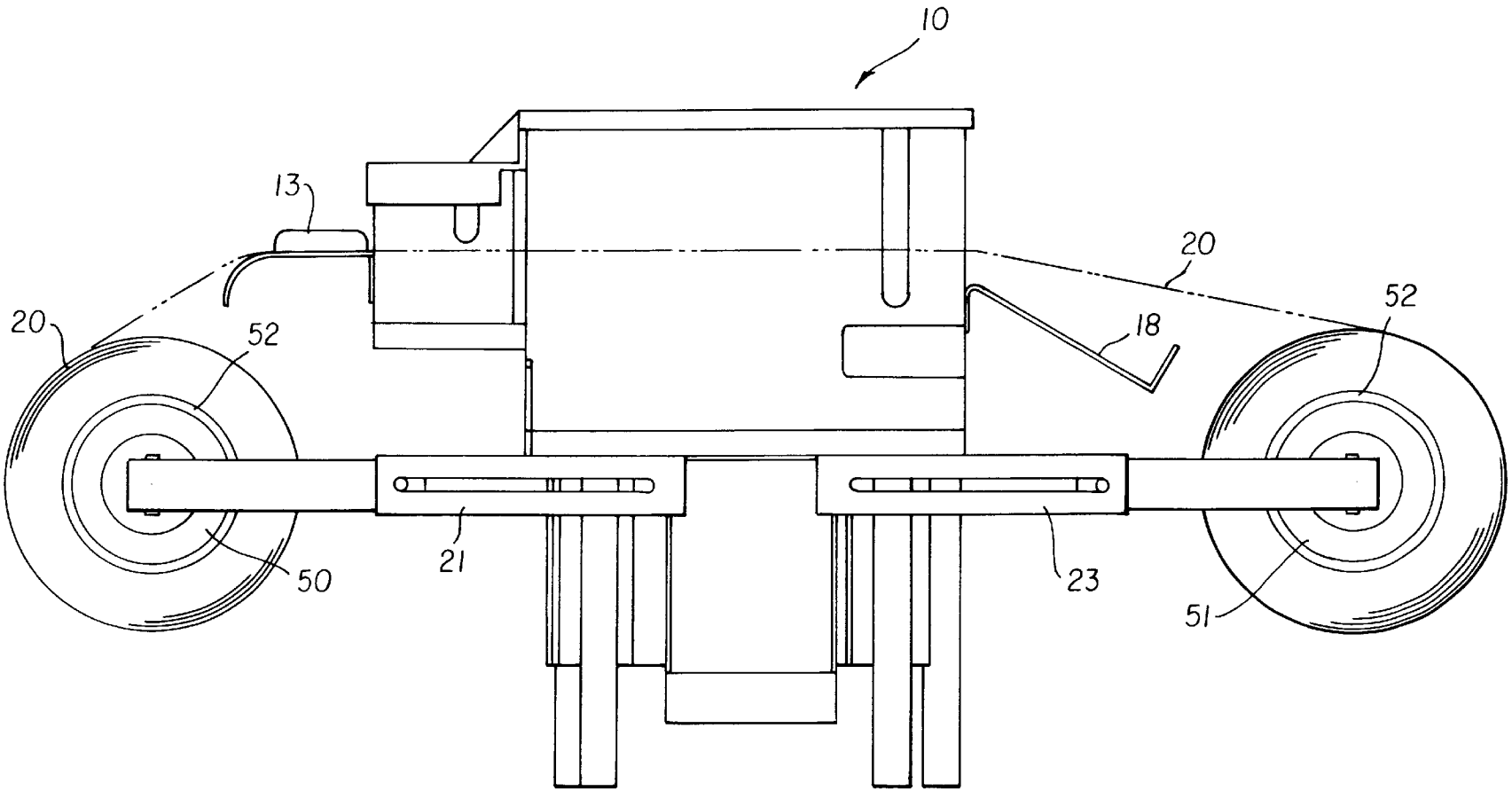
FIG. 3 is a side elevational view of the apparatus of FIG. 1 when in the web feed mode of operation.

The apparatus 10 in Figs. 1 and 2 is shown set up in a mode for receiving and applying a coating onto a plurality of individual cut sheets of photographic paper having images thereon and FIG. 3 illustrates the apparatus 10 set up in a second mode for receiving and applying a coating on a continues web of media, such as photographic paper.

Referring to FIGS. 1 and 2, the apparatus 10 includes a first supply assembly 12 for supplying a media to apparatus 10 of a first format, which in this embodiment is in the form of individual cut sheets, such as photographic prints. In the particular embodiment illustrated first supply assembly 12 comprises a tray 13. The coating mechanism of apparatus 10 operates as a feed mechanism (not shown) for individually feeding the cut sheets 14 from the tray 13 to the entrance 15 of coating section 16. A coating is applied the individual cut sheets in coating section 16. It is to be understood that any appropriate feed mechanism may be provided. The apparatus 10, further includes an output tray 18 for retaining individual prints that have passed through the exit 17 coating section 16. The output tray 18 may be designed to stack all of the prints one on top of the other or provide separate bins for storing individual or a group of prints. The output tray 18 is preferably designed such that it will not interfere with use of a web passing through coating section 16 as illustrated FIG. 3, discussed below.

In FIG. 3 there is illustrated a media of a second format passing through apparatus 10. As can be seen the second format comprises a continuous web 20 of photographic media. The web 20 is positioned such that it does not interfere with supply tray 13 or output tray 18 thereby not requiring any major modification or change in operation to the apparatus 10. In this embodiment, a retractable supply arm assembly 21 is provided for supplying a web 20 of media to coating section 16 and a retractable take-up arm assembly 23 for taking up the web 20 after it leaves coating section 16. The assemblies 21, 23 are for use when it is desirable to coat web 20 continuously through apparatus 10. The retractable retractable supply arm assembly 21 is positioned on the entrance side of the apparatus 10 for supplying media to entrance 13 and the take-up arm assembly 23 is positioned on the outlet side of apparatus 10 for receiving media from exit 17. The assemblies 21, 23 are similar in structure and operation like parts and operation.

Figure 4A:
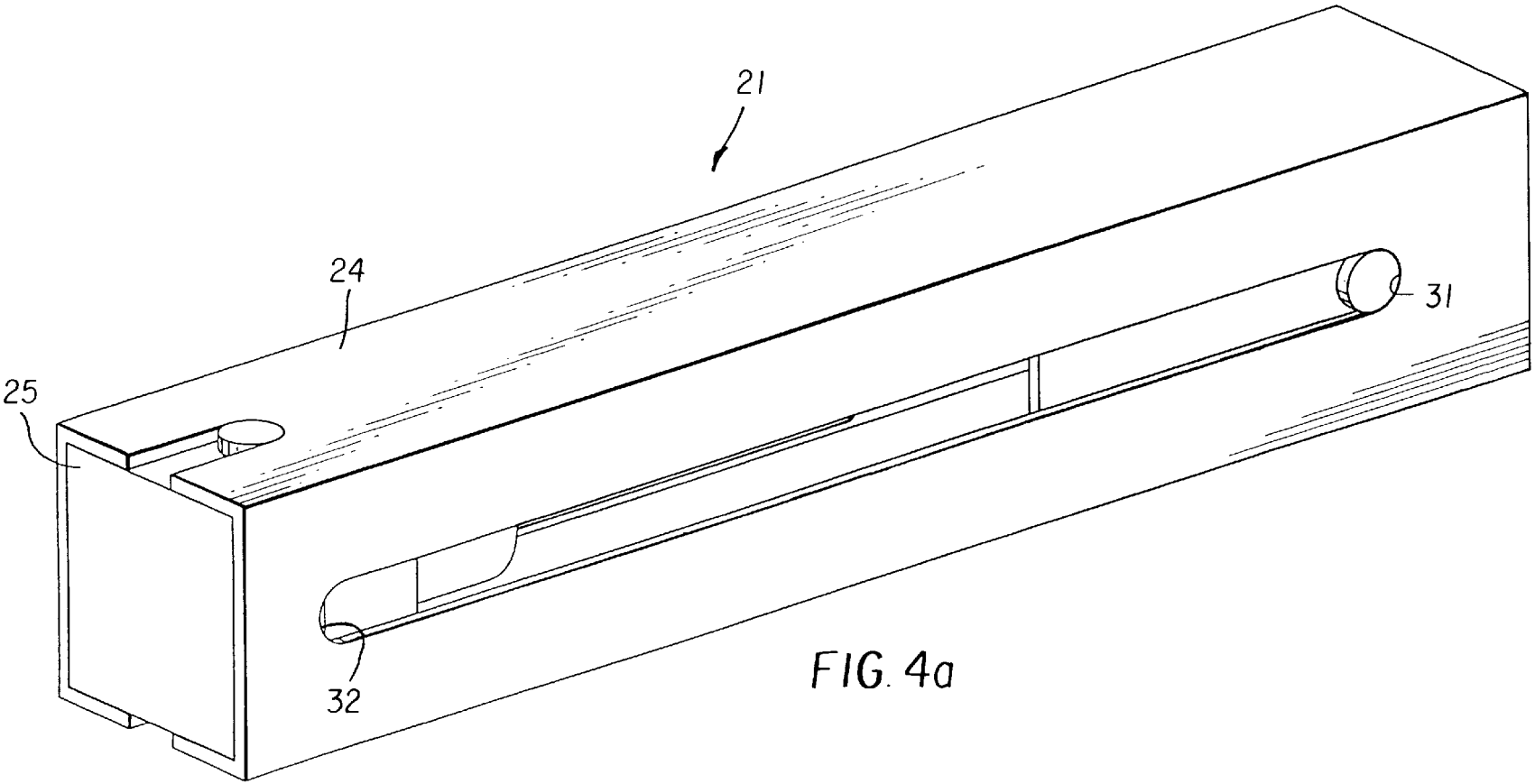
FIGS. 4*a*–4*e* illustrate the sequential steps of opening one of the retractable arm assembly for receiving a supply or take-up core about which a web of photosensitive material may be helically wound.
Figure 4B:
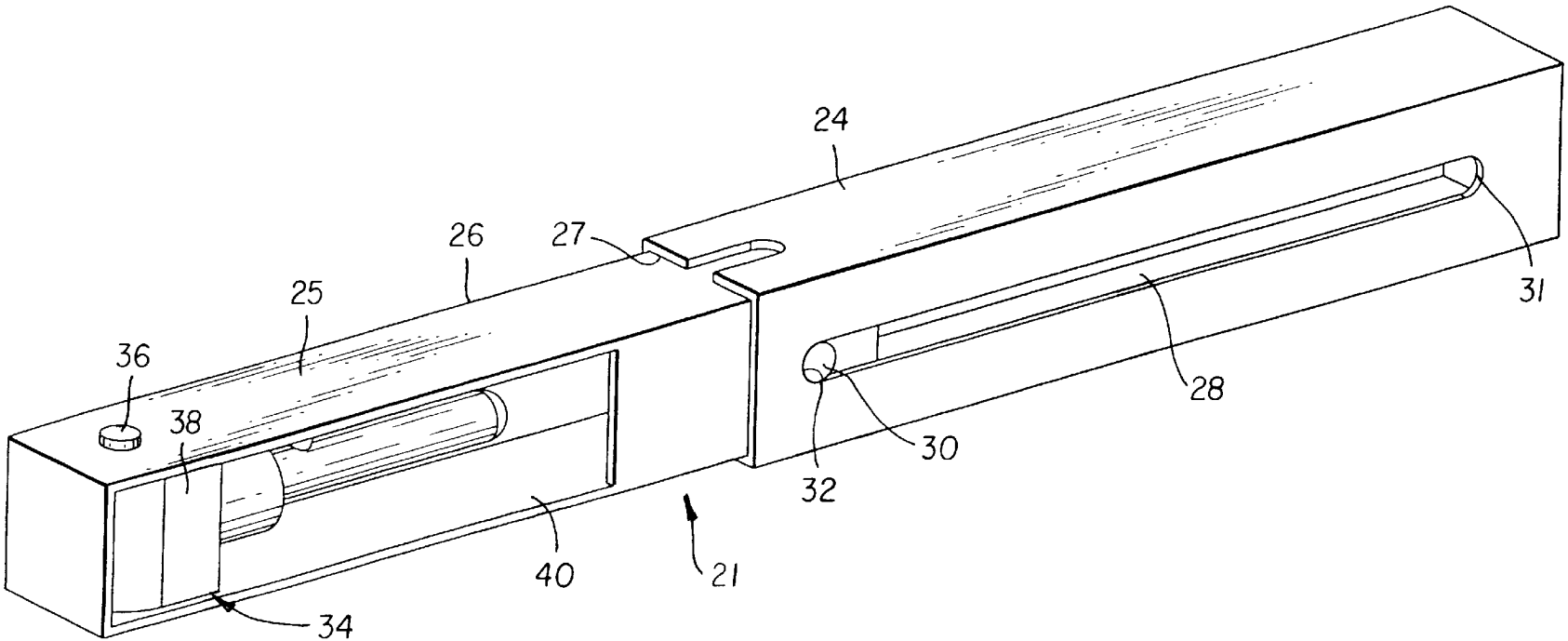
Figure 4C:
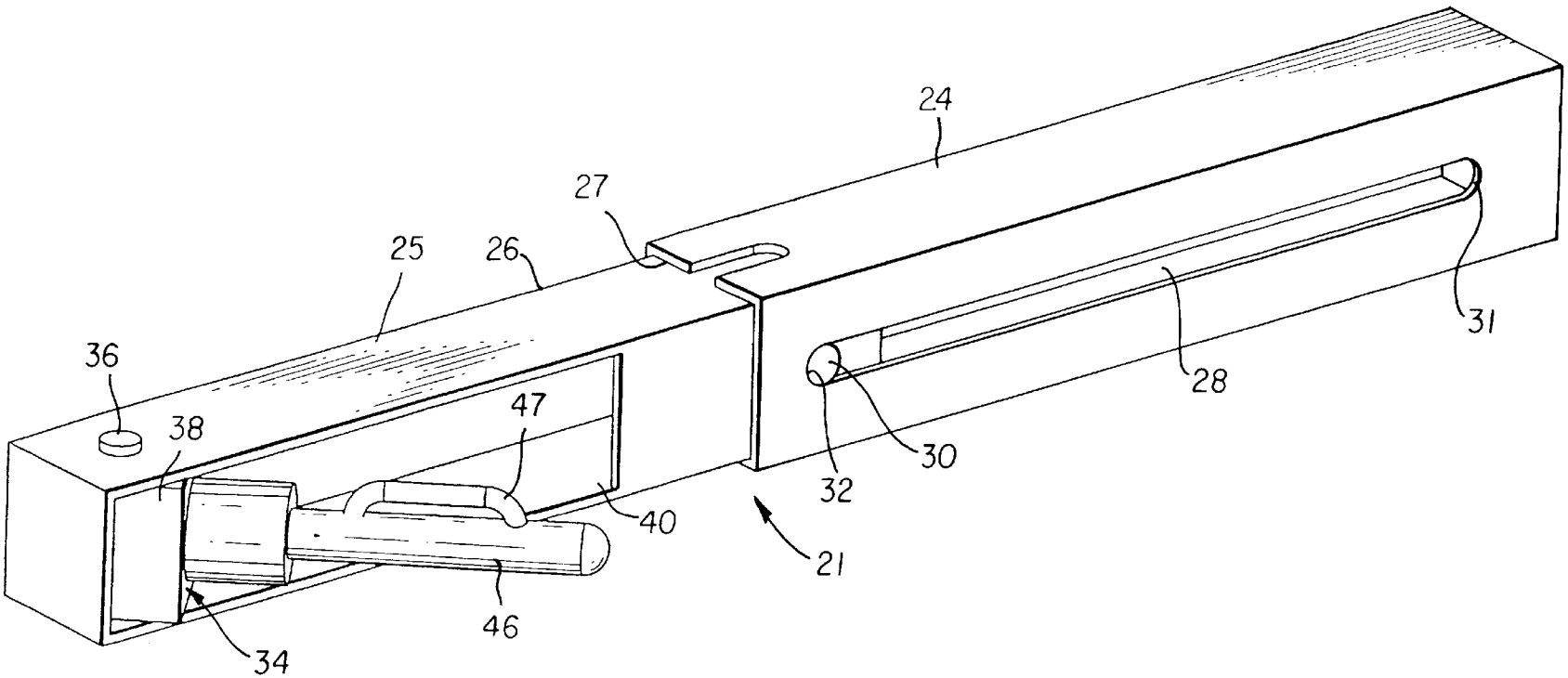
Figure 4D:
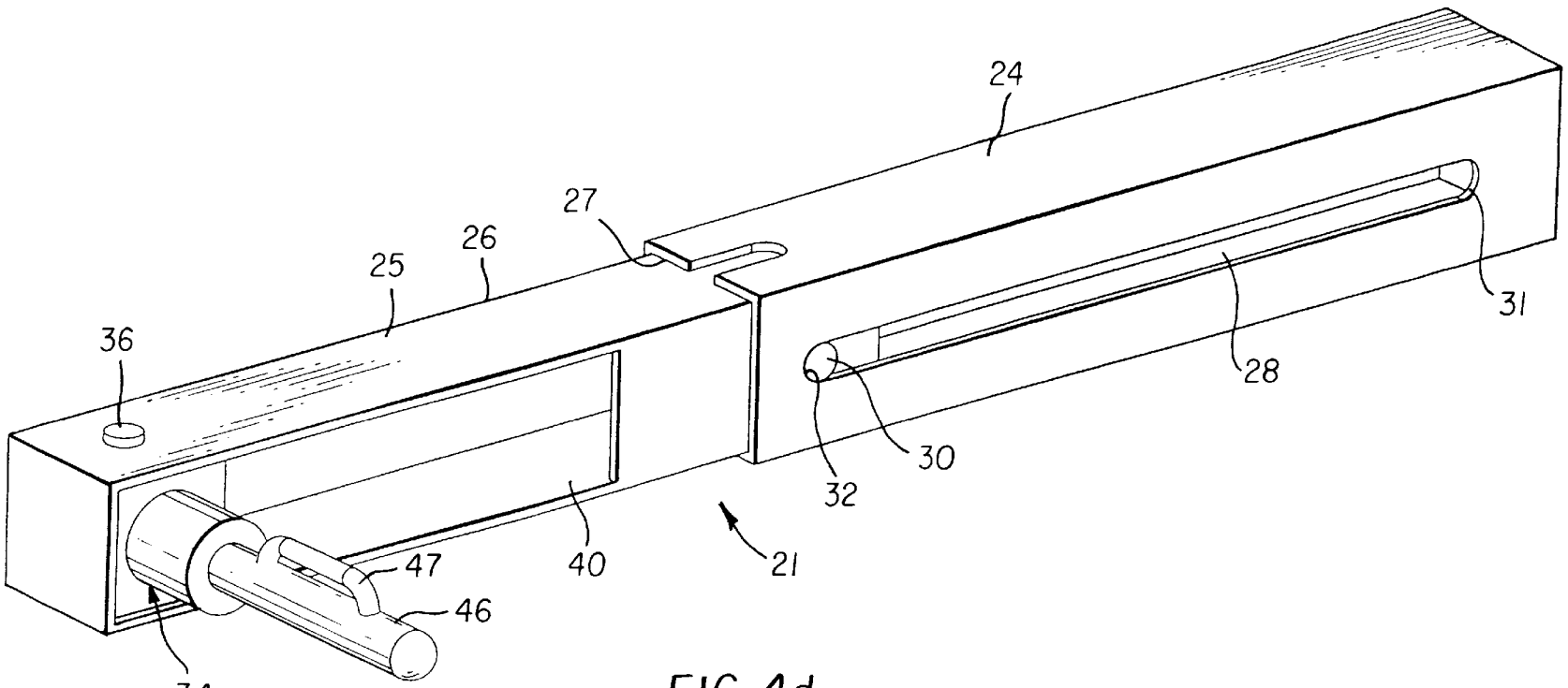

Referring to FIGS. 4*a*–4*d* there illustrated in greater detail retractable arm assembly 21 in the storage position. When in the storage position arm assembly 21 is in the non-operational state so that cut sheets can be coated by apparatus 10. When in the storage position the supply arm and take-up assemblies 21, 23 do not interfere with the operation of the device and also minimizes the space taken up by apparatus 10. Retractable arm assembly 21 includes an outer sleeve 24 having a retractable extension arm 25 which is slidably mounted to sleeve 24. Preferably as illustrated, the retractable arm 25 has an outer configuration 26 which corresponds to the inner configuration 27 of the outer sleeve 24, but is slightly smaller so as to allow easy movement of sleeve within arm 25. In the particular embodiment illustrated, the retractable arm 25 has a substantially square cross section, but may be any suitable cross section. The outer sleeve 24 is provided with a pair of oppositely disposed slots 28, each designed to receive a projection 30 which extends from the retractable arm 25. Projection 30 is slidable within its associated slot 28. The slots 28 each have an inner end 31 and outer end 32 for limiting the movement of projection 30 within slot 28 as illustrated in FIGS. 4*a* and 4*b* thereby limiting the movement of arm 25. FIG. 4*a* illustrates the retractable arm 25 in its stored position and FIG. 4*d* illustrates the retractable arm 25 in its fully extended position.

Figure 4E:
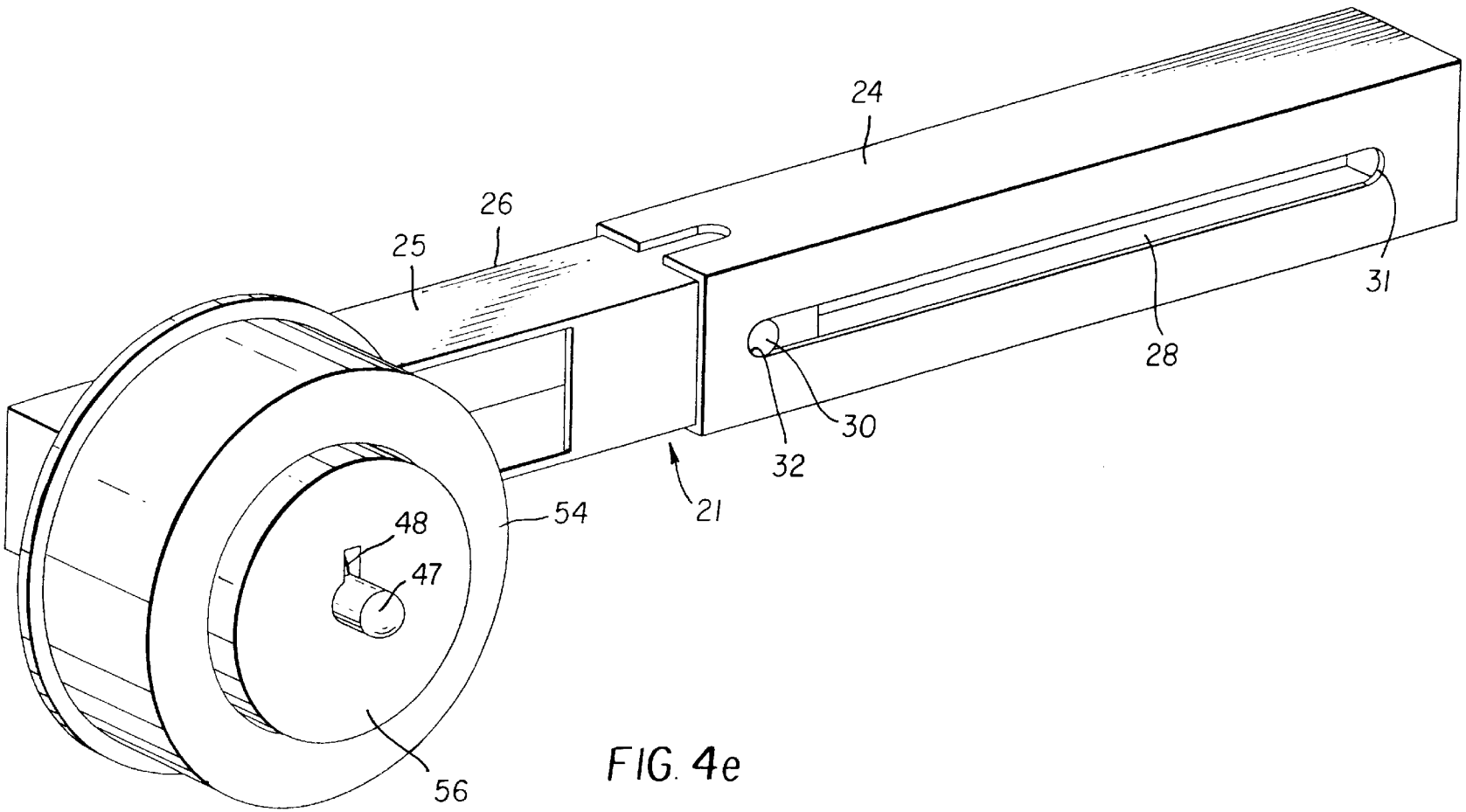

A retractable mounting pin assembly 34 is rotatably mounted to retractable arm 25 by a pin 36 which extends through the base 38 of pin assembly 34. The pin 36 is secured to arm 24 by an any appropriate technique. The retractable arm 25 is provided with a recess 40 in which the pin assembly 34 is stored when not in use. FIG. 4*b* to FIG. 4*d* illustrates moving the pin assembly 34 from the stored position (FIG. 4*b*) to the fully operation position illustrated in FIG. 4*d*. After the retractable arm 24 has been fully extended, the pin assembly 34 is rotated outward, for example by simply manually operation, as illustrated in FIG. 4*c* until the mounting pin assembly 34 reaches the fully extended position illustrated in FIG. 4*d*. The mounting pin assembly 34 includes a mounting projection 46 and integral alignment projection 47. The mounting projection 46 and alignment projection 47 are designed to engage a mounting slot 48 provided on a roller assembly 50. In particular, the mounting slot 48 has a shape designed to mate and receive the mounting projection 46 and alignment projection 47 as illustrated in FIG. 4*e*. The roller assembly 50 is designed to receive a web of photosensitive media that is wound about a supply core 52 as illustrated in FIG. 3. In the preferred embodiment illustrated the roller assembly 50 includes an outer race 54 that rotate about an inner stationary section 56. The roller assembly 50 is brake roller assembly designed to provide a slight braking force so that a sufficient tension is provide to keep the web taught. The stationary section 56 includes the mounting slot 48 for receiving projection 46. As previously discussed an appropriate drive mechanism is provided for taking off of the web from the core on which it is supplied.

Figure 5A:
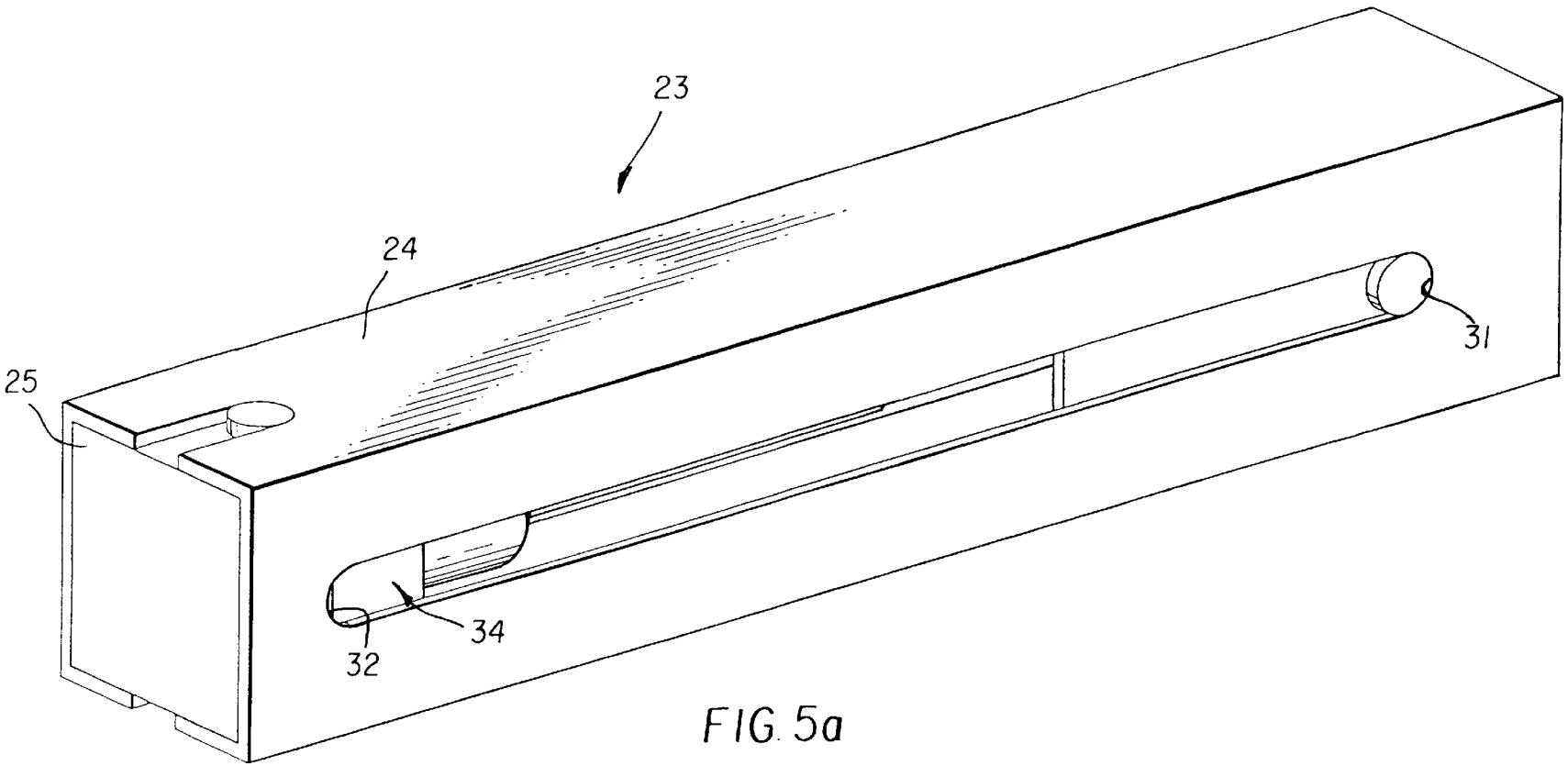
FIGS. 5*a*–5*f* illustrate the sequential steps of opening the other arm assembly having a drive mechanism for driving of the take-up roller.
Figure 5B:
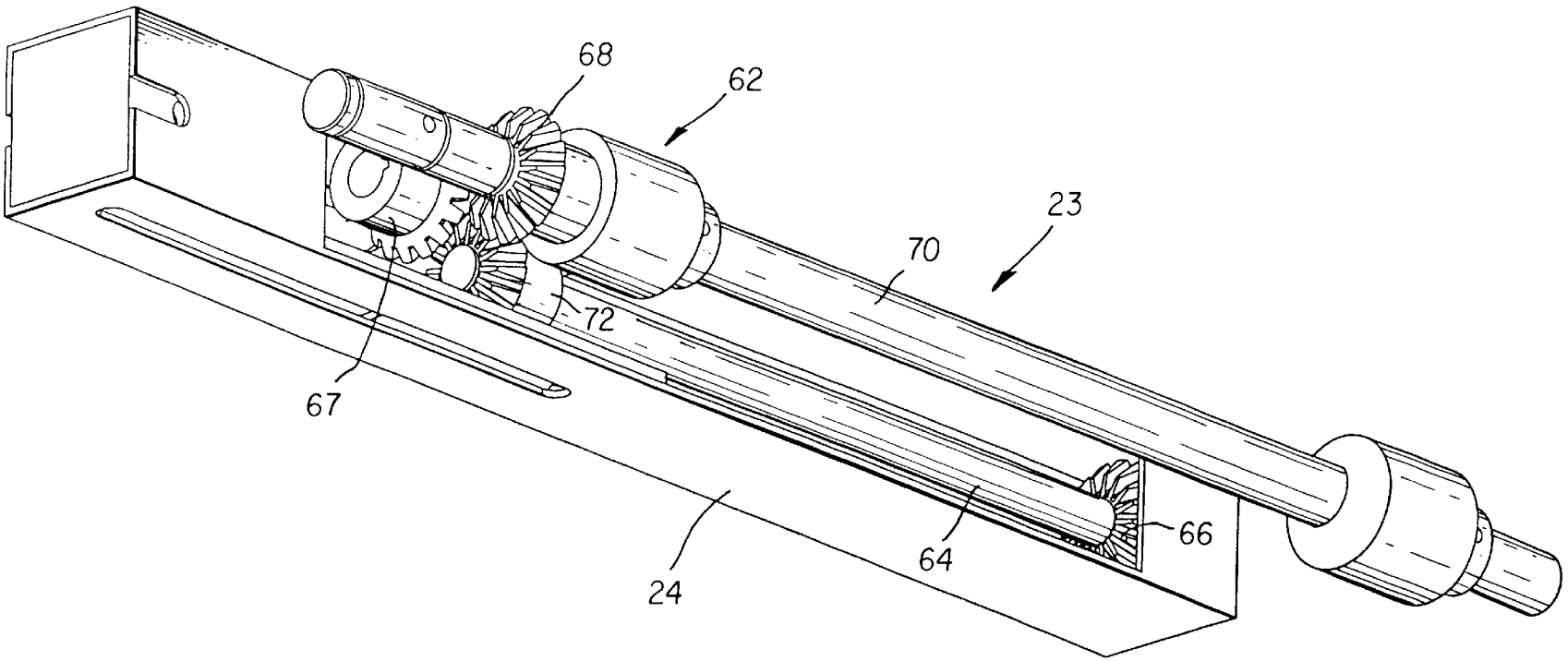
Figure 5C:
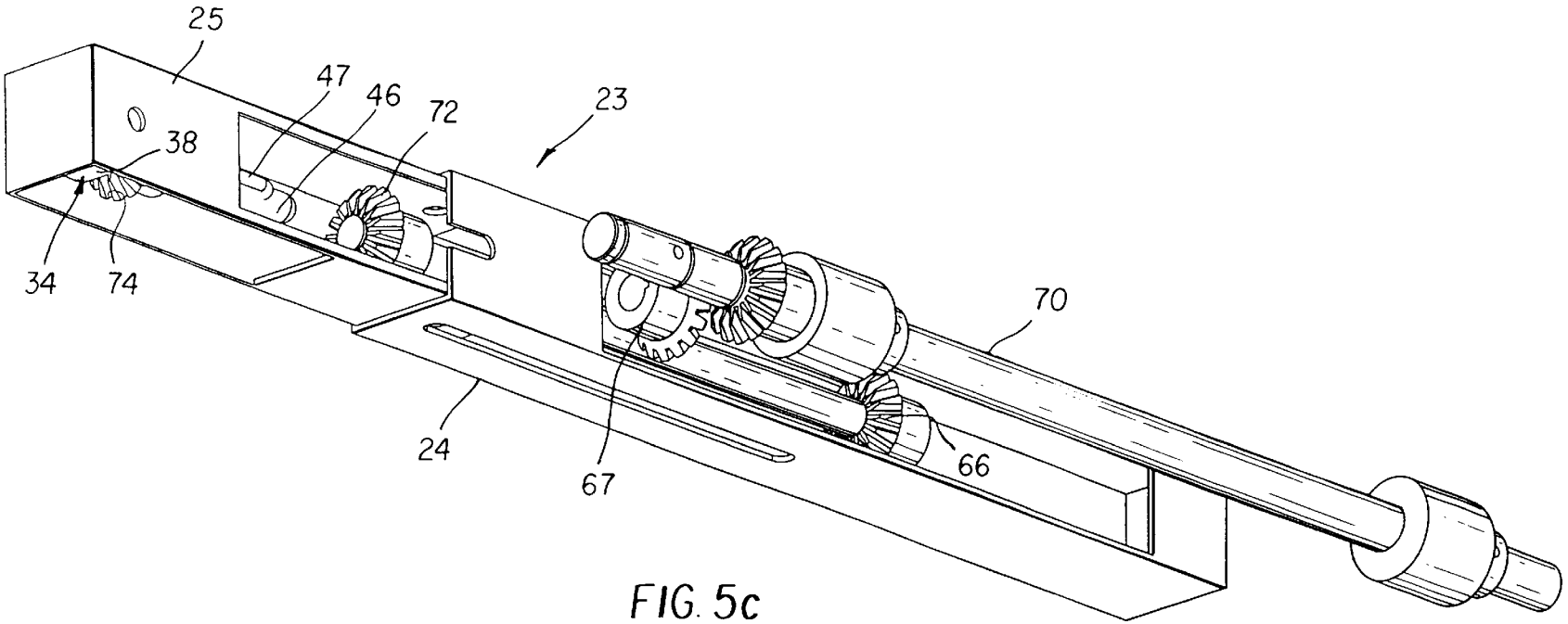
Figure 5D:
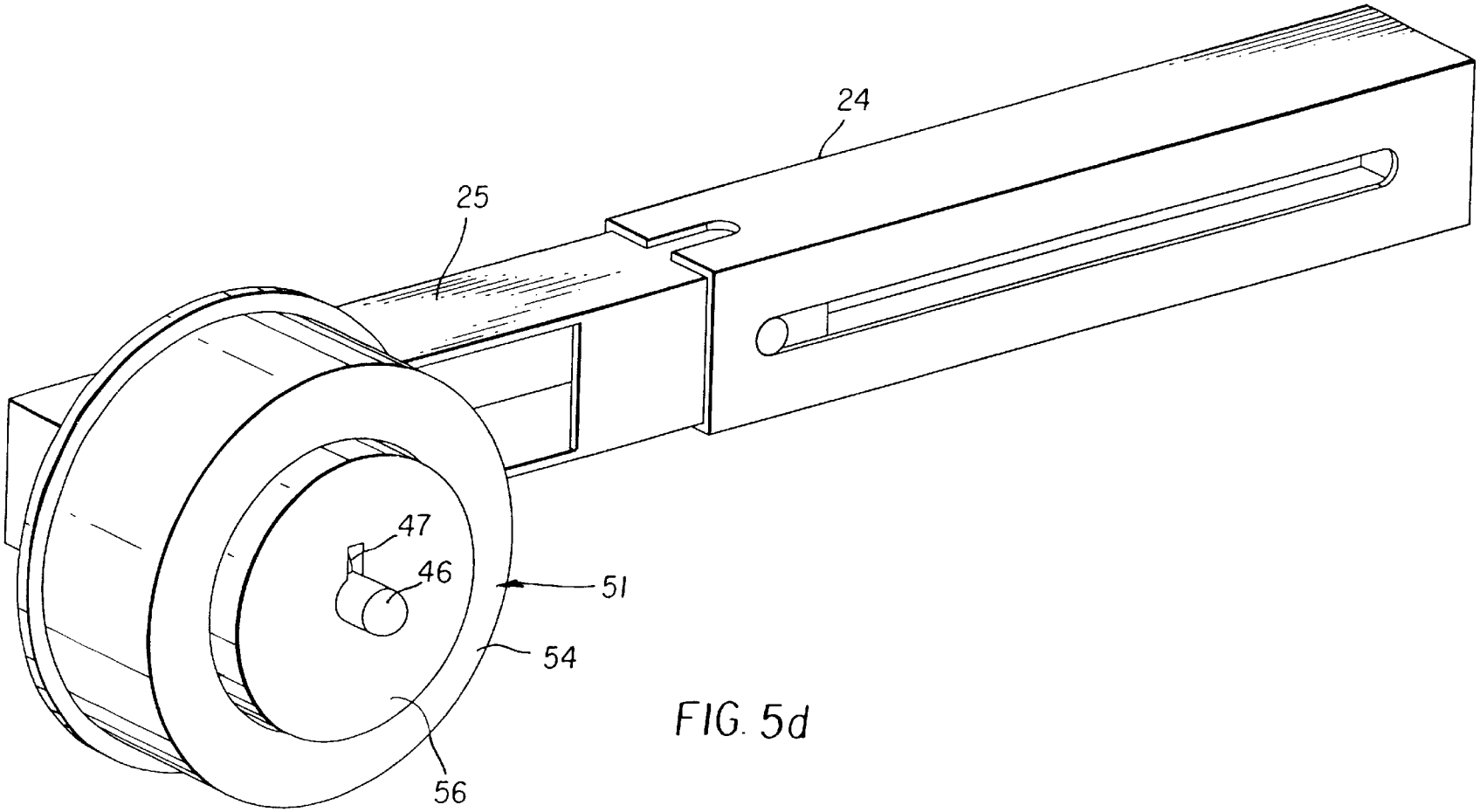
Figure 5E:
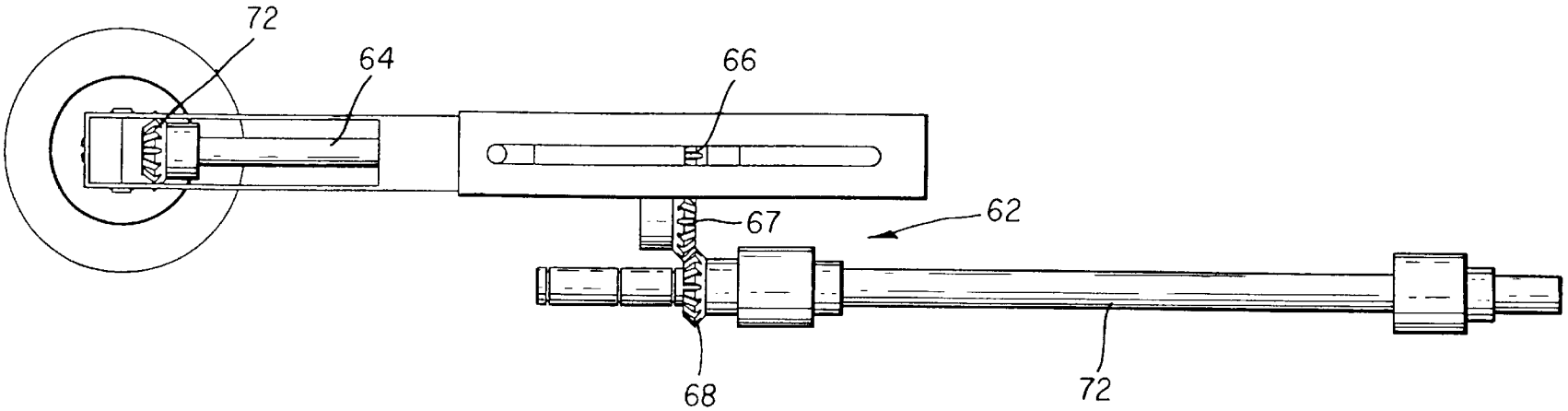
Figure 5F:
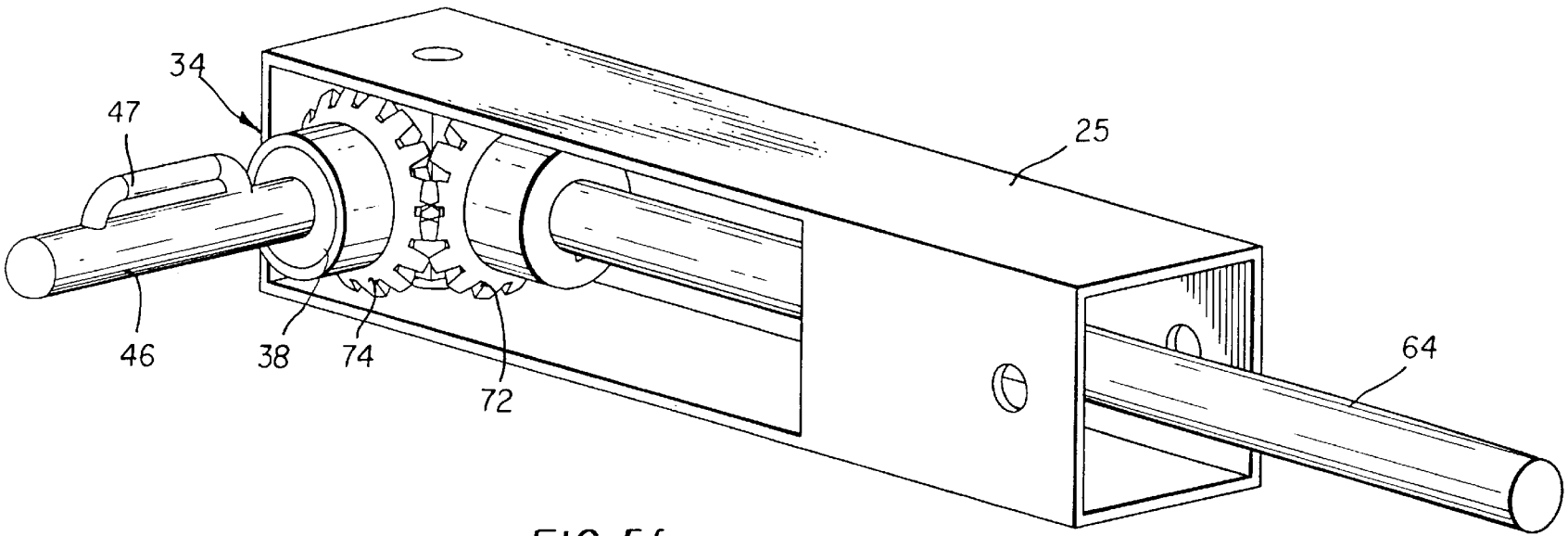

Referring to FIGS. 5*a*–5*f* there is illustrated retractable arm assembly 23, which is similar to arm assembly 21 like numerals indicating like parts an operation. Arm assembly 23 is different from assembly 21 in that a drive assembly 62 is provided with assembly 23 to drive take-up roller 51 placed thereon. FIGS. 5*a* and 5*b* illustrate the arm assembly in the retracted state. In FIG. 5*b* the arm assembly 23 partially broken illustrating the internal components and how it is mates with the drive of apparatus 10. As illustrated in FIGS. 5*a*–5*f* a transmission shaft 64 is slidably mounted to assembly 23 such that is moves with extension arm 25. FIG. 5*c* illustrates the arm assembly 23 moving from the position in FIG. 5*a* to the fully extended position in FIGS. 5*e* and 5*f*. A first bevel gear 66 is provided at the rear section of shaft 64 which is designed to engage mating gear 67 which in turn engages a drive gear 68 on drive shaft 70 in apparatus 10 when the assembly is in the fully extended position as illustrated in FIGS. 5*e*–5*f*. When in the retracted position as illustrated in FIGS. 5*a* and 5*b*, the gear 66 is disengaged from gear 67. The forward end of shaft 64 is provided with a second bevel gear 72, see FIGS. 5*b* and 5*c*, which is designed to engage a mating bevel gear 74 on the back of base 38 of pin assembly 34, see FIGS. 5*c* and 5*f*. In this embodiment the mounting projection 46 is designed to rotate the inner race 56. Once the arm 25 in it fully extended position, projection 46 is rotated outward as illustrated in FIG. 5*f* so that gear 74 engages gear 72. Therefore once shaft 70 is rotated the roller 51 mounted on projection 46 will rotate. It is of course understood that appropriate controls are provided for activating and stopping drive shaft 70 as needed. The roller 51 is designed to operate as a slip clutch. Therefore if too much tension is provided, the outer race 54 will slip with respect to the outer race 56.

When operating the apparatus 10 in the cut sheet mode, the roller assemblies 50, 51 are placed in the storage bin 60 and the retractable arms 25 are retracted into the outer housing sleeves 24. When operating the apparatus 10 in the web mode, the retractable arm assemblies 21, 23 are opened to the operation position. As can be seen, the changing from one operating mode to another, for example, from the cut sheet mode to the web mode, can be accomplished very quickly and easily and is done so with relatively inexpensive mechanisms.

In the particular embodiment illustrated only a single retractable arm assembly is provided on the supply and take-up side of the coating apparatus, the present invention is not so limited. If desired a pair of aligned arm assemblies may be provided on each side of the apparatus 10 so that the core is retained on both sides.

It is to be understood that various modifications and changes may be made without departing from the scope of the present invention, the present invention being defined by the following claims.

PARTS LIST

| | |
|---|---|
| 10. apparatus | 36. pin |
| 12. first supply assembly | 38. base |
| 13. tray | 40. recess |
| 14. sheets | 46. mounting projection |
| 15. entrance | 47. integral alignment projection |
| 16. coating section | 48. mounting slot |
| 17. exit | 50. roller assy. |
| 18. output tray | 51. drive take-up roller |
| 20. web | 52. supply core |
| 21. retractable supply arm assy. | 54. outer race |
| 23. take-up arm assy. | 56. inner stationary section |
| 24. sleeve | 62. drive assy. |
| 25. retractable extension arm | 64. rear section of shaft |

-continued

| PARTS LIST | |
|---|---|
| 26. outer configuration | 66. first bevel gear |
| 27. inner configuration | 67. mating gear |
| 28. slots | 68. drive gear |
| 30. projection | 70. drive shaft |
| 31. inner end | 72. second bevel gear |
| 32. outer end | 74. mating bevel gear |
| 34. retractable mounting pin assy. | |

What is claimed is:

1. An apparatus for applying a liquid coating on to photosensitive media, said apparatus comprising:

a coating section for applying a liquid coating on to a photosensitive media having an entrance and an exit;

a first supply assembly for supplying a first media of a first format adjacent said entrance for supplying said first media to said coating section; and a retractable second retractable supply assembly and a retractable taking-up assembly for supplying and taking up a second media of a second format adjacent said entrance for supplying said second media to said coating section, said second format being different from said first format.

2. An apparatus according to claim 1 wherein said first supply assembly does not interfere with use of said retractable second supply assembly.

3. An apparatus according to claim 1 wherein said first format is a cut sheet format and said second format is a web format.

4. An apparatus according to claim 1 wherein said retractable second supply assembly comprises a retractable arm assembly.

5. An apparatus according to claim 4 wherein said retractable arm assembly comprises an outer sleeve and an extension arm slidable mounted to said outer sleeve.

6. An apparatus according to claim 5 wherein said retractable arm assembly further includes a rotatably mounted retractable mounting pin assembly, said mounting pin assembly including a mounting projection placement in a mating slot of a roller assembly.

7. An apparatus according to claim 6 wherein said roller assembly comprises an outer race which rotates about a stationary section, said stationary section having said mating slot.

8. An apparatus according to claim 7 wherein said roller comprises a brake.

9. An apparatus according to claim 1 said retractable take-up assembly comprises a retractable arm assembly.

10. An apparatus according to claim 9 wherein said retractable arm assembly comprises an outer sleeve and an extension arm slidable mounted to said outer sleeve.

11. An apparatus according to claim 10 wherein said retractable arm further includes a rotatably mounted retractable mounting pin assembly, said mounting pin assembly including a mounting projection placement in a mating slot of a roller assembly.

12. An apparatus according to claim 11 wherein said roller assembly comprises an outer race which rotates about a stationary section, said stationary section having said mating slot.

13. An apparatus according to claim 12 wherein said mounting projection is driven.

14. An apparatus according to claim 13 wherein said retractable arm assembly includes a slidable shaft which engages a drive shaft in said apparatus.

15. An apparatus for applying a liquid coating on to photosensitive media, said apparatus comprising:

a coating section for applying a liquid coating onto a photosensitive media having an entrance and an exit;

a first supply assembly for supplying a first media of a first format, said first format comprising a cut sheet format for supplying said first media to said coating section; and a retractable second supply assembly and a retractable taking-up assembly for supplying and taking-up a second media of a second format to said coating section, said second format comprising a web format, said retractable second supply assembly and said retractable taking-up assembly each comprising a retractable arm assembly.

16. An apparatus according to claim 15 wherein said first supply assembly does not interfere with use of said retractable second supply assembly.

17. An apparatus according to claim 16 wherein said retractable supply assembly and retractable take-up assembly each comprises an outer sleeve and an extension arm slidable mounted to said outer sleeve.

18. An apparatus according to claim 17 wherein said retractable arm further includes a rotatably mounted retractable mounting pin assembly, said mounting pin assembly including a mounting projection placement in a mating slot of a roller assembly.

19. An apparatus according to claim 18 wherein said roller assembly comprises an outer race which rotates about a stationary section, said stationary section having said mating slot.

20. An apparatus according to claim 19 wherein said mounting projection of said retractable take-up assembly is driven.

21. An apparatus according to claim 20 wherein said retractable arm assembly includes a slidable shaft which engages a drive shaft in said apparatus.

* * * * *